United States Patent [19]

Kobayashi

[11] 4,373,296

[45] Feb. 15, 1983

[54] DEBURRING APPARATUS FOR WORKPIECES

[75] Inventor: Hisamine Kobayashi, Nagoya, Japan

[73] Assignee: Kabushiki Kaisha Shikishima Tipton, Aichi, Japan

[21] Appl. No.: 110,843

[22] Filed: Jan. 10, 1980

Related U.S. Application Data

[62] Division of Ser. No. 972,487, Dec. 22, 1978, Pat. No. 4,280,304.

[30] Foreign Application Priority Data

Jan. 25, 1978 [JP] Japan ..... 53-7723

[51] Int. Cl.[3] ..... B24B 29/00; B24B 31/00; B24B 51/00

[52] U.S. Cl. ..... 51/3; 51/19; 51/215 R

[58] Field of Search ..... 51/3, 4, 17, 19, 163.2, 51/164.2, 215 R

[56] References Cited

U.S. PATENT DOCUMENTS

| | | | |
|---|---|---|---|
| 546,114 | 9/1895 | Chatfield | 51/17 X |
| 2,715,796 | 8/1955 | Beard | 51/3 |
| 2,912,795 | 11/1959 | Jessup | 51/3 |
| 2,922,259 | 1/1960 | Rada | 51/3 X |
| 3,430,388 | 3/1969 | Gabrielli | 51/3 |
| 4,172,339 | 10/1979 | Balz | 51/164.2 |
| 4,240,229 | 12/1980 | Ohno | 51/19 |

*Primary Examiner*—Nicholas P. Godici

*Attorney, Agent, or Firm*—Wenderoth, Lind & Ponack

[57] ABSTRACT

A deburring apparatus for finishing workpieces includes machines having rotary tools and a gyro-finishing machine. The workpieces are conveyed by an intermittently-driven charging conveyor with a given pitch. The workpieces are transferred from the conveyor to each machine or held at stations of the rotary tools. The machines operate in parallel with each other and successively on all workpieces.

11 Claims, 18 Drawing Figures

DEBURRING APPARATUS FOR WORKPIECES

This is a division of application Ser. No. 972,487, filed Dec. 22, 1978, now U.S. Pat. No. 4,280,304.

BACKGROUND OF THE INVENTION

1. Field of the Invention

The present invention relates generally to a fully automatic finishing apparatus, and more particularly to a deburring apparatus which removes undesired scales or burrs from workpieces, such as cams of particular or complex profiles having a central bore and/or slits, as well as conditions the surface for successive operations.

2. Description of the Prior Art

In the workpiece deburring art, various types of apparatus such as buffing, wire-brushing, barrel-finishing and others have heretofore been in practical use. Such conventional devices involve considerable human labor during operation, and also produce many unacceptably poor quality finished products which have unprocessed burrs still remaining or excessively processed burrs. Thus, such devices present disadvantages with regard to the operating efficiency and the quality of thus obtained products. It is also noted that the conventional apparatus cannot perform simultaneous satisfactory deburring and surface conditioning.

SUMMARY OF THE INVENTION

In view of the disadvantages of the conventional devices, the present invention provides an improved deburring and surface conditioning apparatus which involves different devices such as rotary tools and barrel-finishing means at different steps depending upon the deburring purposes and whose operations are performed during controllable predetermined time intervals, and workpiece conveying means which carries workpieces between the different steps or devices. The structure according to the invention eliminates human interventions during the different, uninterrupted deburring operations and produce satisfactorily deburred and surface conditioned products. It is therefore worthwhile to note advantages with regard to labor savings and operating efficiency.

Objects to be processed for deburring or surface conditioning according to the present invention are workpieces of complex shapes such as cams shown in FIGS. 15 and 16, and shaft bearing assemblies shown in FIGS. 17 and 18, which have a central bore 2, 2*a*, slit 3, burred edges and rough surfaces. The apparatus according to the invention comprises means to remove undesired burrs present along the bordering edges of all adjacent sides of a workpiece directly by means of tools (such as conical-or frustoconical-tipped rotary tools later to be described) and finishing the surface by methods including buffing and gyro-finishing. The last-mentioned finishing process involves both surface conditioning and deburring operations, but the invention aims specifically at the deburring process and thus the descriptions which follow hereinafter are directed to the deburring. Accordingly, the apparatus according to the invention essentially comprises, for example, buffing means, a barrel-finishing means to permit both deburring and surface-conditioning processes, workpiece conveying means to move the workpieces successively to the above means, to hold the workpieces tightly at buffing stations, to transfer the workpieces from the conveying means to the machine and vice versa, by robot-hand means.

The above-mentioned rotary tools may include cloth buffs, formed plastic tools embedded with abrasives (so-called non-woven tools), wire brushes, plastic tools of fibrous abrasive media, all having certain elastic and/or plastic properties and abrading power. It should be understood that the rotary tool referred to herein means any or all of the tools mentioned above. The barrel finishing apparatus is available in various modes of operation such as rotating, vibratory, centrifugal, recipro- and gyro-finishing operations. Among those, the line operation which permits workpieces to be processed successively at certain regular intervals of time is best suited to the present invention, whereas the other modes of operations such as rotating, vibratory, centrifugal, and recipro-finishing operations, which permit a number of workpieces in a finishing container to be finished therein at a time and with so-called batch system, are inconvenient and not suited for the present invention. In view of the above observation and consideration, the present invention employs the gyro-finishing operation mode, whose construction and operation are described below in further detail for the convenience of basic understanding thereof. A cylindrical tub has a vertical shaft extending therethrough, and rotates the tub, which contains an amount of abrasive media and wherever necessary an amount of compound solution. In working condition, the tub is in either stationary or rotary positions. Workpiece holders are further provided which hold workpieces by chucking, and are mounted in position on a turret. In operation, the turret causes an orbital movement of the workpieces with the holders turning on their axes, thereby allowing workpiece surfaces to be rubbed against the abrasive media in the tub. It should be noted that during the finishing operation, workpieces held by the holders are always placed in the tub and only one or two shafts which carry workpieces whose finishing has been completed is lifted or moved up, independently of the other working shafts. A workpiece to be finished can be attached to the lifted holder in place of the finished workpiece which has been removed from the same holder. In other words, workpieces in deburring and finishing operations can be processed without stopping during the exchange operations of the workpieces. During the steady working operation, all workpieces are always placed at their respective positions in the various deburring means and on the conveyors, and are successively transferred, from one position to next, each time the operation for the preceding workpiece is completed. Whenever one or more workpieces to be processed are placed in a first position, the same number of finished workpieces are taken away from the final stage to be transferred to a further process outside the system, if required. In accomplishing operations for the above-described workpieces requiring the slit deburring, center-bore polishing, center-bore deburring and surface conditioning operations, automatically, either of two methods is possible. One is a method in which successive workpieces carried by an intermittently-driven charging conveyor are transferred to a deburring means from the conveyor, processed and again returned to the conveyor during time-intervals in which the conveyor remains stationary. The other is a method in which a workpiece holding assembly is provided for holding a workpiece in position on the conveyor which remains stationary so that the workpiece is processed during the conveyor stationary interval, and after completion of that process, the workpiece is then transferred by the conveyor to the next means. In both methods, a finished separate conveyor may be provided for transferring workpieces from the gyro-finishing means to the subsequent steps. It should be noted that individual workpieces which have been processed by the gyro-finishing means are taken away from the gyro-finishing means at regular intervals, during which intervals workpieces are charged into the system from the first charging position. Thus, the second conveyor has the same moving pitch as the first conveyor. After the gyro-finishing treatment, washing, anti-corrosive treating, air-blowing, drying and other treatment may be provided along the second conveyor.

OBJECTS OF THE INVENTION

A principal object of the present invention is the provision of means for both surface conditioning and removing burrs from profiled workpieces satisfactorily by unmanned operation. All involved deburring and surface conditioning devices including a gyro-finishing machine are in a line operation and are operatively connected with each other by means of conveyors and robot hands.

BRIEF DESCRIPTION OF THE DRAWINGS

Other objects and features of the present invention will become clear from the detailed description of several preferred embodiments which follows hereinafter with reference to the accompanying drawings, in which.

DESCRIPTION OF THE PREFERRED EMBODIMENTS

Figure 1:
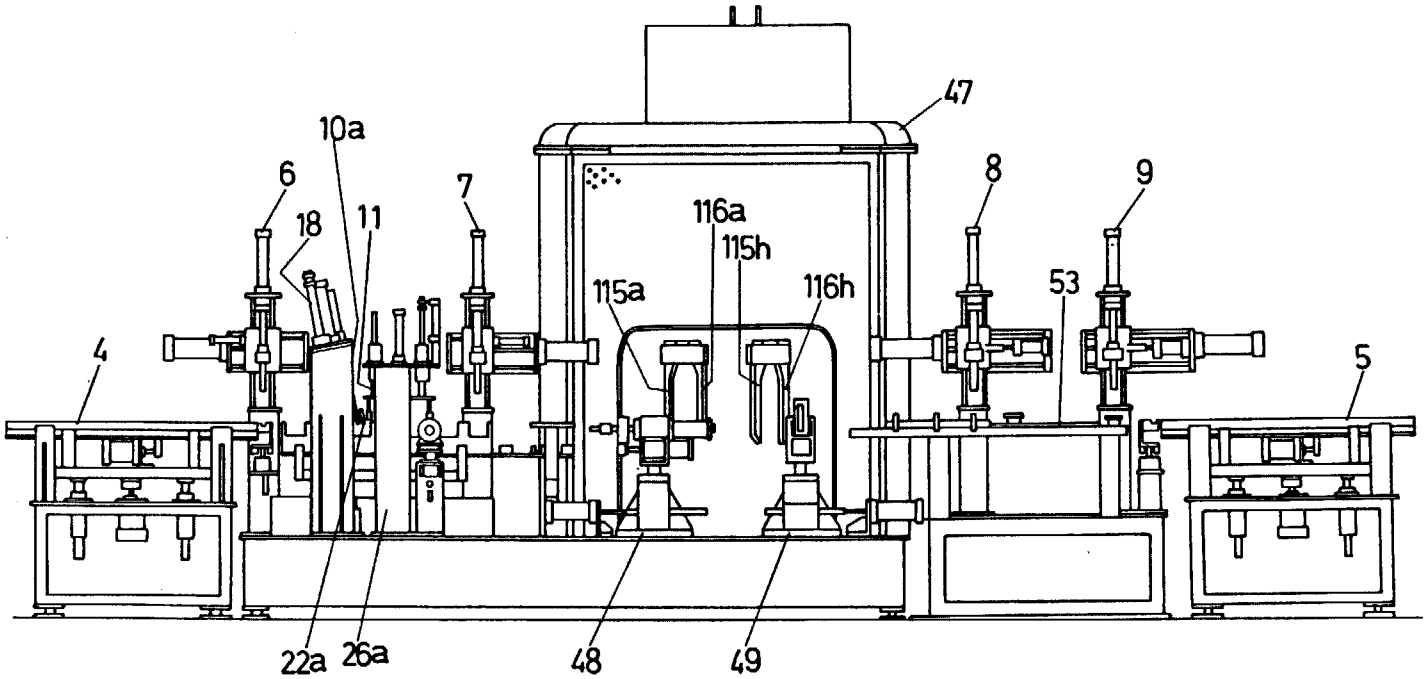
FIG. 1 is a front elevation view of a workpiece deburring apparatus embodied according to the present invention.
Figure 2:
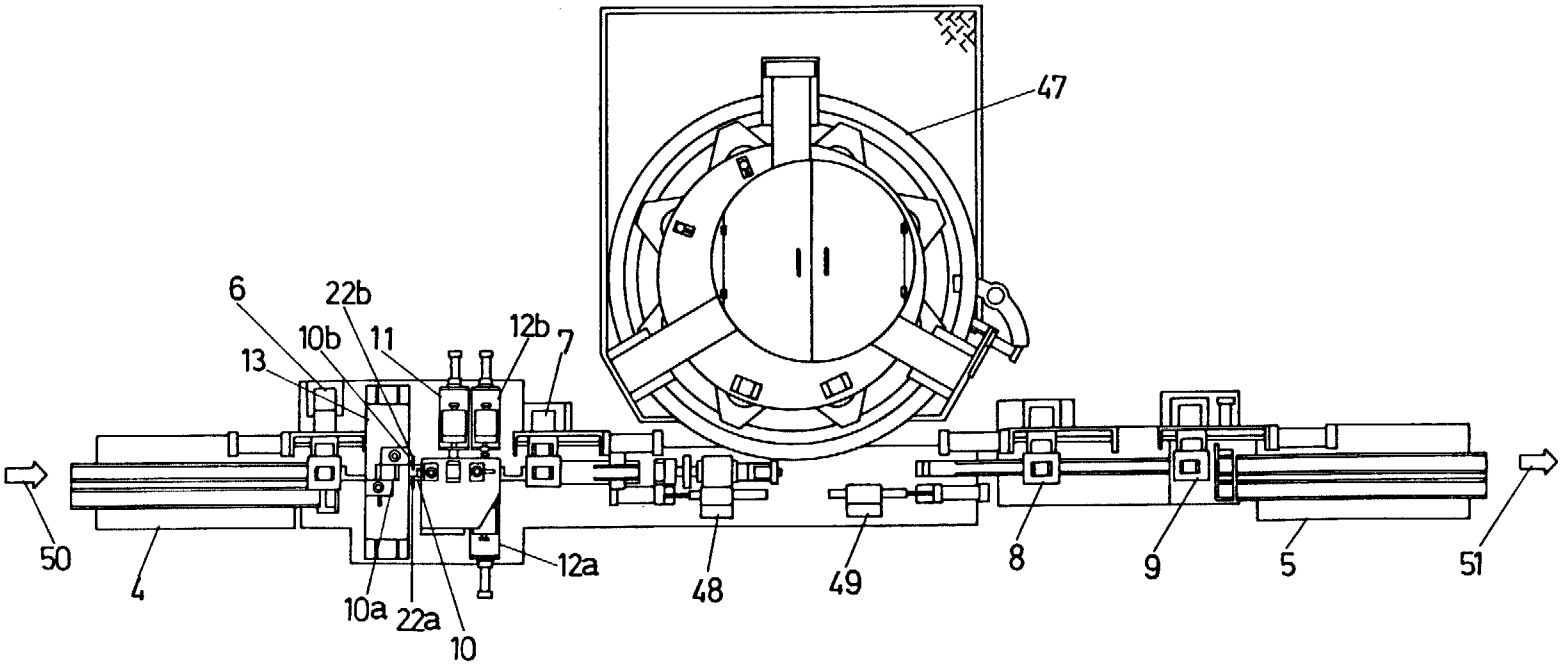
FIG. 2 is a plan view of the apparatus of FIG. 1.
Figure 4:
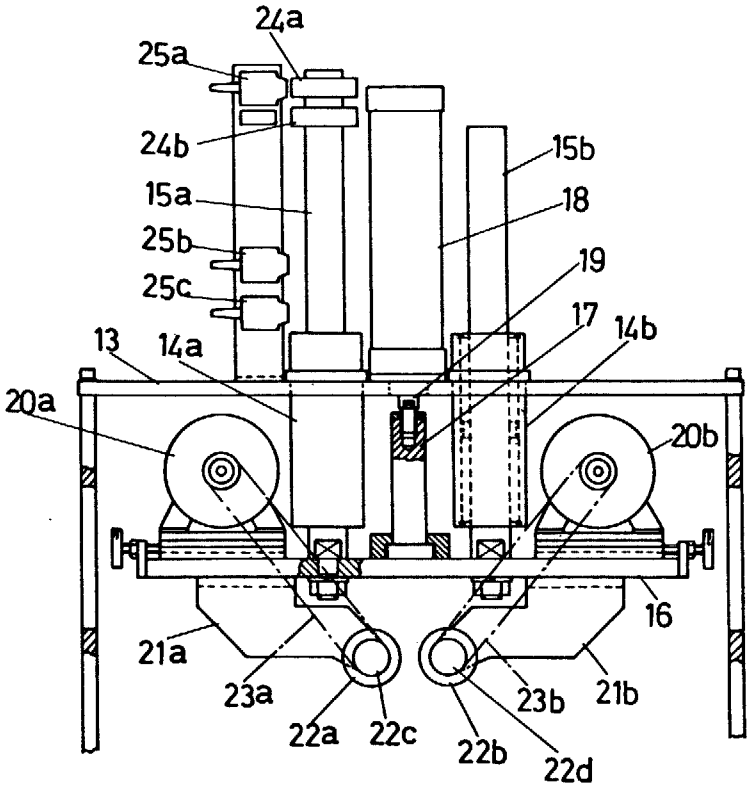
FIG. 4 is a side elevation view of the apparatus of FIG. 3.
Figure 3:
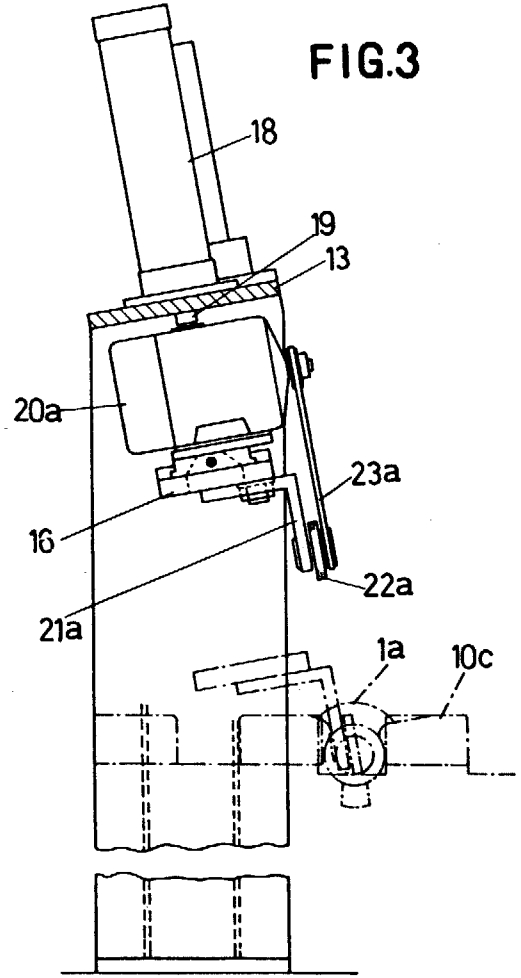
FIG. 3 is a front elevation view of a slit deburring apparatus embodied according to the invention.
Figure 6:
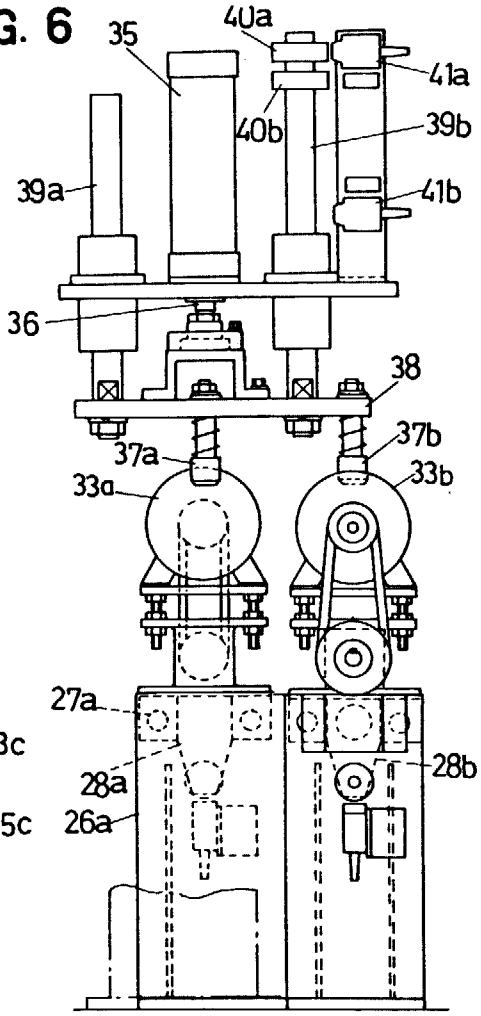
FIG. 6 is a front elevation view of the apparatus of FIG. 5.
Figure 5:
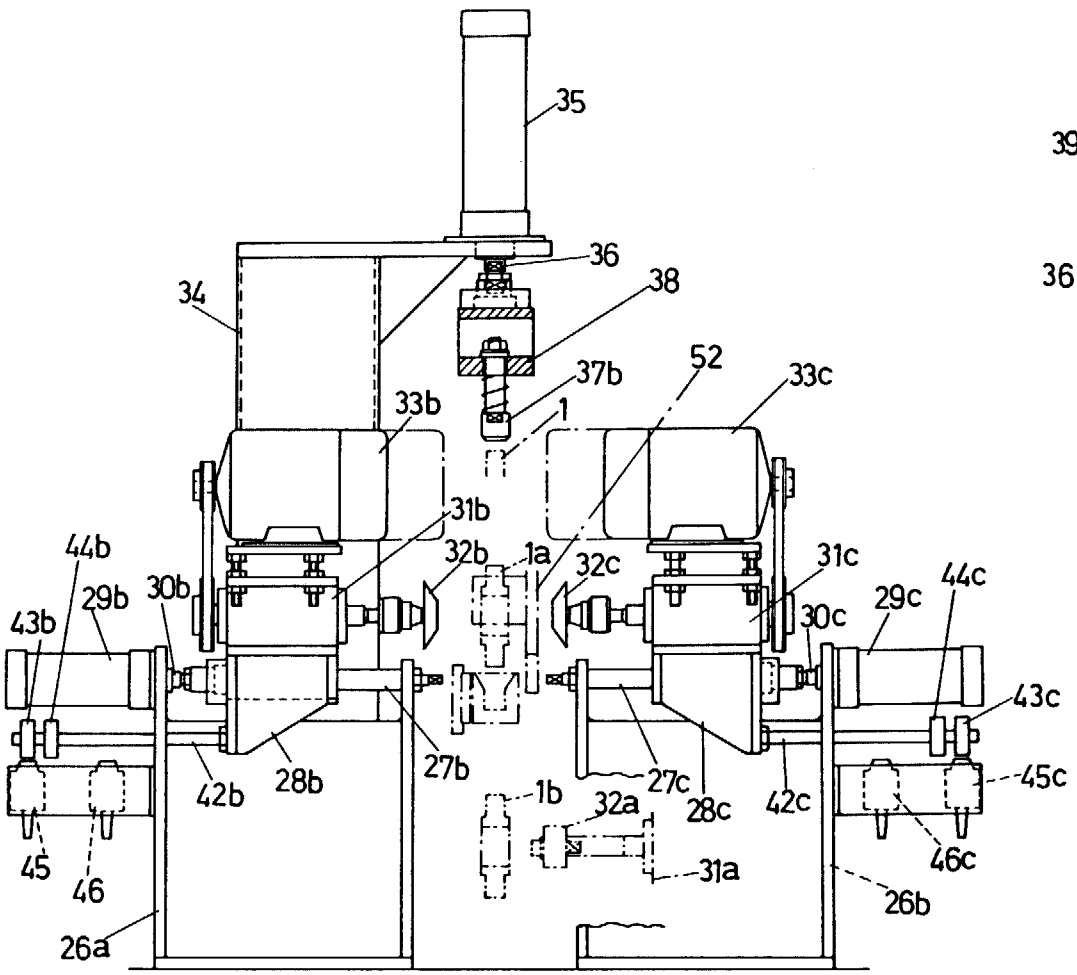
FIG. 5 is a side elevation view of the central bore finishing and deburring apparatus.
Figure 15:
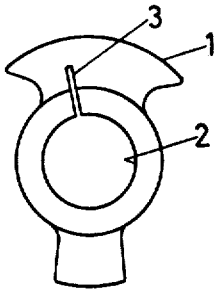
FIG. 15 is a front view of a typical workpiece to be processed according to the invention.
Figure 16:
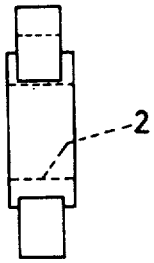
FIG. 16 is a side view of the workpiece shown in FIG. 15.

FIGS. 1 to 6 illustrate the construction of the deburring apparatus according to the present invention which includes deburring means for various purposes depending upon the kind of deburring process which will later be described in detail. An example of a workpiece, such as a cam, to be processed by this apparatus is shown in FIGS. 15 and 16. Reference numeral 4 designates a conveyor which carries workpieces successively in alignment and delivers workpieces one after another into the deburring system. A conveyor, designated by reference numeral 5, carries finished workpieces from the deburring system to a next step outside the system, and has a substantially similar construction to that of the conveyor 4. Robot hand assemblies 6, 7, 8 and 9 which are per se known are operated to hold workpieces and move the same from one process to another, and, if necessary, to allow workpieces to vary their positions and to be chucked in the various positions. In FIGS. 1 to 6, the deburring apparatus comprises slit deburring means 10*a* and 10*b*, central bore polishing means 11, central bore deburring means 12*a* and 12*b* and gyro-finishing means 47. These individual means will now be described specifically. The slit deburring means 10*a*, 10*b* is shown in detail in FIGS. 3 and 4, and is generally structured on a frame 13. More specifically, a plurality of guide bearings 14*a*, 14*b* are rigidly secured to the frame 13, and guide posts 15*a*, 15*b* extend through the guide bearings 14*a*, 14*b*, respectively, for up and down movements for tools 22*a*, 22*b*. The guide posts 15*a*, 15*b* are secured at one end to a supporting base 16. A supporting rod 17 secured at one end to the supporting base 16 is connected at the other end to a piston rod 19 of a fluid-operated cylinder assembly 18 mounted on the frame 13. The supporting base 16 has a pair of electric motors 20*a* and 20*b* mounted thereon and has downwardly extending flanges 21*a*, 21*b* at the lower parts of which rotary tool shafts 22*c*, 22*d* are rotatably connected to the motors 20*a*, 20*c* to be driven by the motors by way of power transmission mechanisms such as belts 23*a*, 23*b* between the shafts and motors. Rotary tools or buffs 22*a*, 22*b* are removably fixed to the shafts 22*c*, 22*d* as shown in FIG. 3, and are brought closer to both sides of a slit of a workpiece as the supporting base 16 is moved up and down by the fluid-operated cylinder 18. Thus, the tools 22*a*, 22*b* on the opposite sides of a slit 3 of a workpiece can remove burrs on the slit 3 of the workpiece. Guide rod 15*a*, for example, has dogs 24*a*, 24*b* at the upper portion thereof for actuating micro switches 25*a*, 25*b*, 25*c* to limit the upper and lower ends of the stroke of the tools. Adjacent to the slit deburring means 10*a*, 10*b* described above are arranged central bore polishing means 11, and central bore deburring means 12*a*, 12*b*, the constructions of which are illustrated in detail in FIGS. 5 and 6. On a pedestal are mounted frames 26*a*, 26*b* within which means 11 and 12*a*, 12*b* are installed. As these means are constructed identically with the exception of the tools used which have different shapes and purposes, the following description applies to both means. Reference numerals in FIGS. 5 and 6 have subscripts a, b and c, and the subscript a indicates the central bore polishing means while the subscripts b and c indicate the central bore deburring means. Horizontal shafts 27*a*, 27*b*, 27*c* extend across the respective frames 26a, 26b, and sliders 28a, 28b and 28c are fitted around the shafts 27a, 27b and 27c slidably along the axes of the shafts. Each of the sliders is connected on one side to a piston rod 30a, 30b, 30c of a respective fluid-operated cylinder 29a, 29b, 29c secured to the respective frame 26a, 26b. Thus, alternate introduction and extraction of pressurized fluid into the piston sides and piston rod sides of the cylinders cause the sliders to reciprocate to the right and left in FIG. 5. The sliders 28a, 28b and 28c have tool heads 31a, 31b and 31c, respectively rigidly secured thereto, to which rotary tools or buffs 32a, 32b and 32c are to be fixed for rotation. Motors 33a, 33b and 33c mounted on the tool heads drive the tools by way of suitable transmission means such as belts. A tool 32a has a cylindrical shape of a slightly greater diameter than the bore diameter of a workpiece shown at 1b in FIG. 5, and tools 32b and 32c are conically or frustoconically shaped as shown in FIG. 5 to be adapted to remove edge burrs on the bore 2 of the workpiece shown at 1a in FIG. 5. A workpiece holding assembly is provided to prevent the movement of the workpiece during the deburring operation of the tools. This assembly comprises a workpiece setter supporting member 34 secured on the pedestal, a fluid-operated cylinder 35 on the supporting member 34, and workpiece fixers 37a and 37b secured to the tip of the piston rod 36 of the cylinder 35. More particularly, the workpiece fixers include a fixer mounting plate 38 to which the fixers are slidably secured and which is operatively connected to the piston rod 36 of the cylinder 35 and is guided by guide poles 39a and 39b. One of the guide poles, which is shown as 39b in FIG. 6, has dogs 40a and 40b which are located to actuate micro switches 41a and 41b on member 38. Rods 42a, 42b and 42c extend from the sliders 28a, 28b and 28c, respectively, and have dogs 43a, 43b, 43c and 44a, 44b, 44c at the forward ends thereof which actuate micro switches 45a, 45b, 45c and 46a, 46b, 46c, respectively, whereby limits of movement of the rotatory tools 31a, 31b and 31c can be determined.

Figure 9:
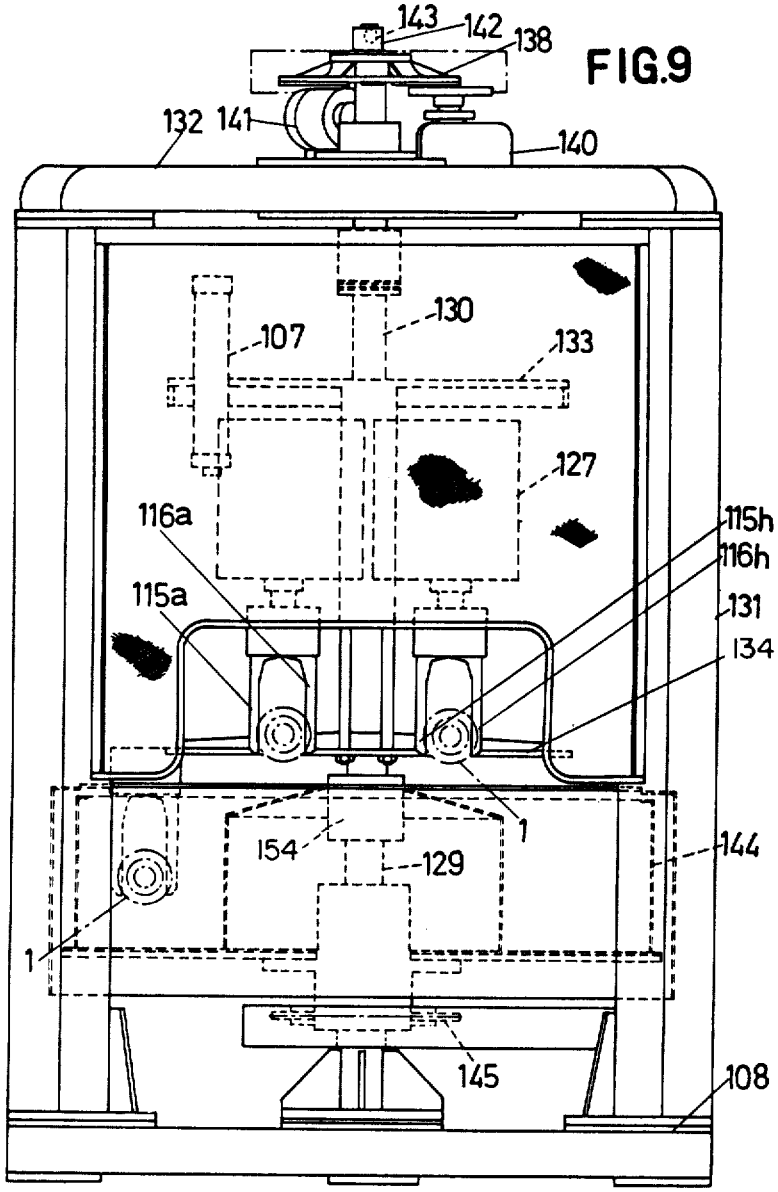
FIG. 9 is a front elevation view of a gyro-finishing apparatus embodied according to the invention.
Figure 10:
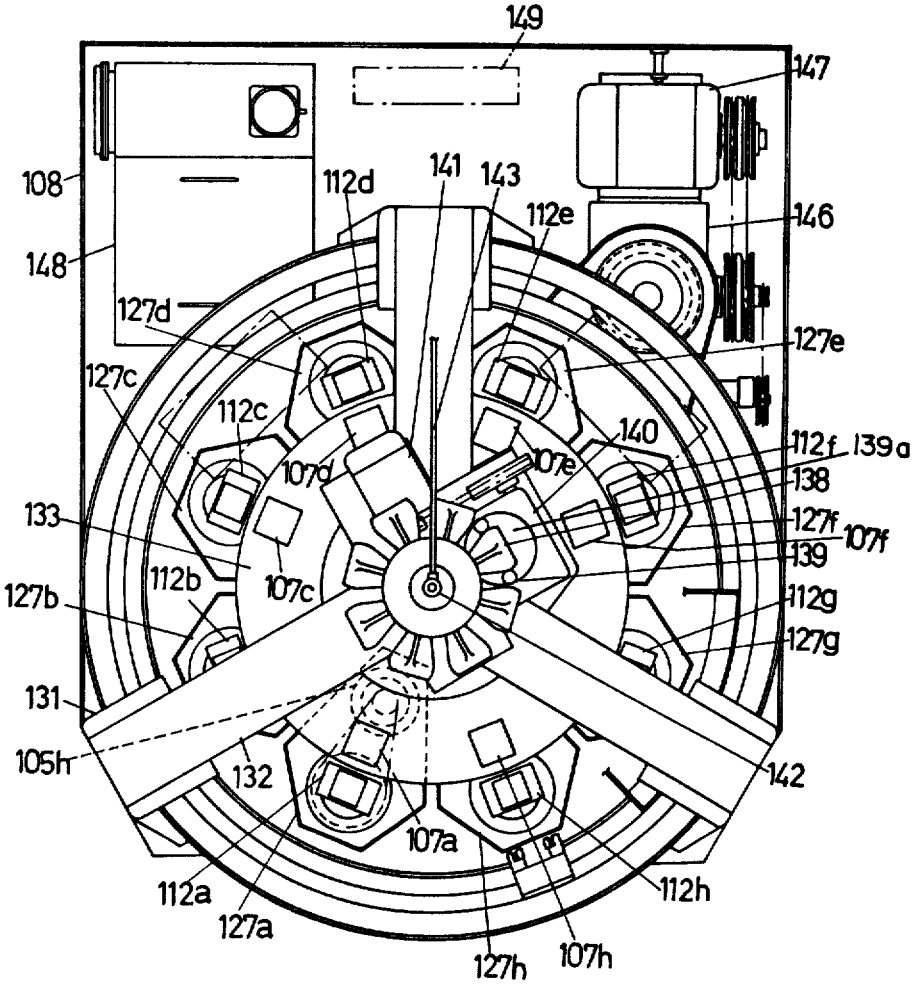
FIG. 10 is a plan view of the apparatus of FIG. 9.
Figure 11:
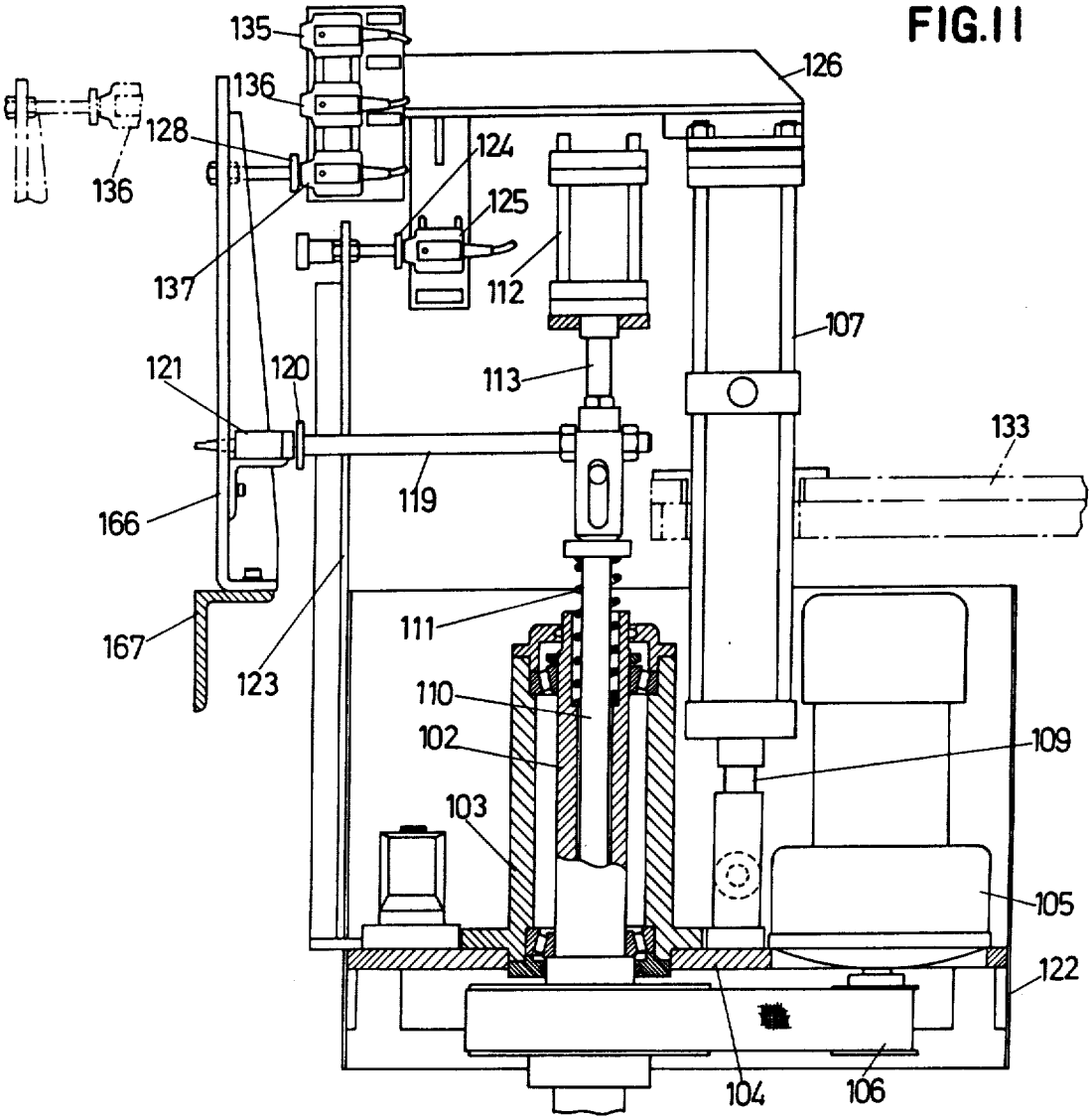
FIG. 11 is an enlarged-scale front elevation view of a workpiece finishing unit to be used with the gyro-finishing apparatus.
Figures 12, 13:
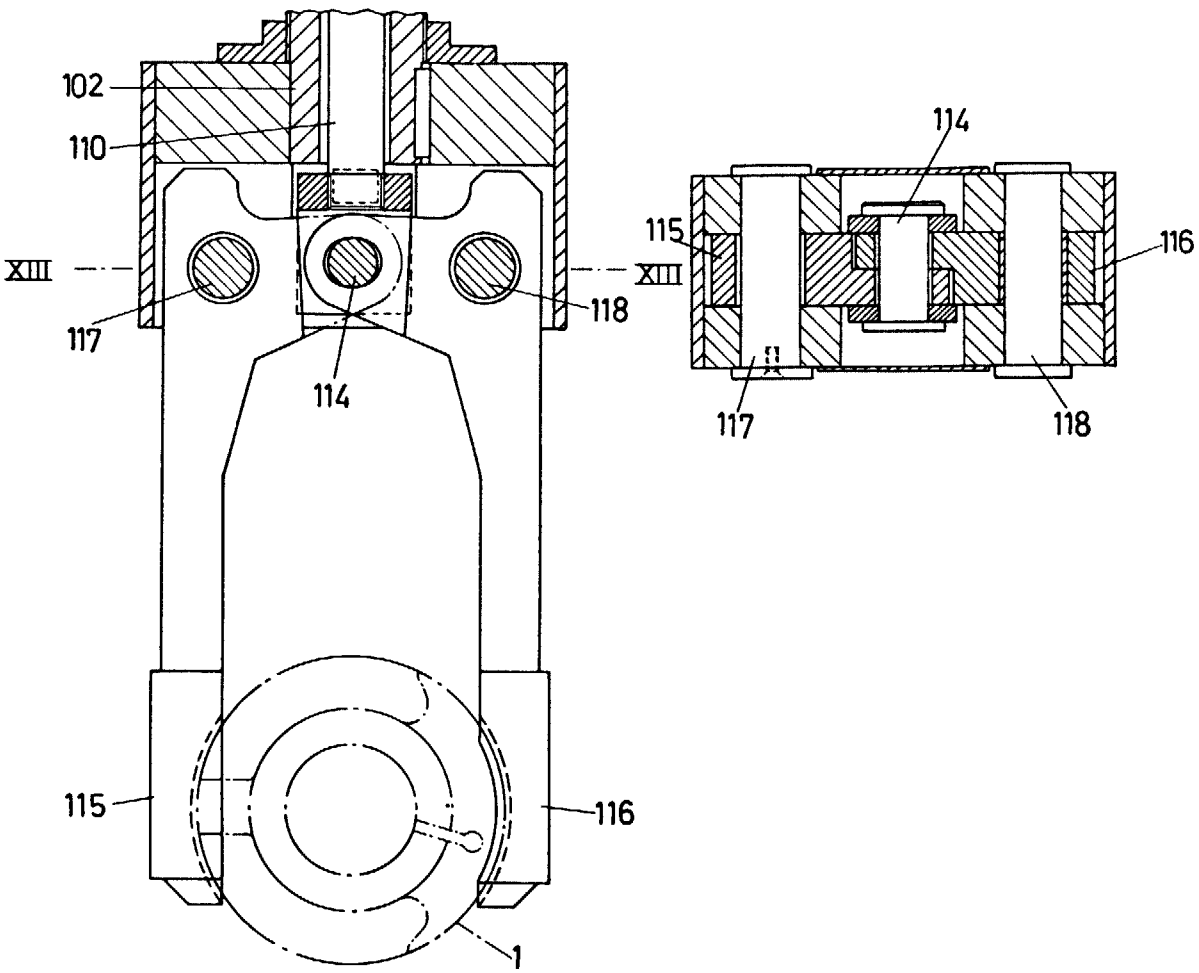
FIG. 12 is an enlarged-scale cross-sectional view of a workpiece chucking device in the gyro-finishing apparatus.
FIG. 13 is a cross-sectional view taken along the line XIII—XIII in FIG. 12.

Referring next to FIGS. 9 and 10, the gyro-finishing means for use with the invention is illustrated, and as shown its structure is accommodated within a frame which includes a base plate 108, vertical supports 131 extending from the base plate 108 and a top support plate 132 over the supports 131. A central shaft 130 extends through the center of the frame and is rotatably supported at its upper end by a bearing secured to the top support plate 132 and on its lower end by a bearing 154 which also supports a rotary shaft 129 for a finishing tub. The central shaft 130 has an upper plate 133 and a lower plate 134 which rotate with the shaft 130, and disposed between the plates 133 and 134 are a plurality of workpiece finishing units generally designated by reference numeral 127 in FIG. 9. Each of the finishing units, individually designated by 127a, 127b, 127c, etc. has a shaft 102 therein to which a workpiece is securely attached by means of a chucking device shown in FIG. 12. Eight units are shown, in the figure, but the number may be varied optionally. For the convenience of description, those units are numbered 127a, 127b, 127c . . . and 127h in the clockwise direction in FIG. 10, and common parts or elements for all units are given alphabetical symbols a, b, c . . . and h which indicate the corresponding units. In the following description of the operation, a part or element whose reference numeral is not accompanied by an alphabetic symbol, such as workpiece attaching shaft 102, will refer generally to each shaft concerned. A part or element represented by a singular form with alphabetic symbol may typically represent a specified part or element whose behavior is different from that of the other part or element of the same numeral. Each workpiece attaching shaft 102 is rotatably supported by a respective bearing 103, and each bearing 103 is rigidly secured to a respective base plate 104 of each unit (see FIG. 11). A respective electric motor 105 is also rigidly mounted on each base plate 104 for driving each shaft 102 by way of a respective belt 106 or any other suitable means such as a chain. Rigidly secured to each base plate 104 is a forward end of a respective piston rod 109 of a respective fluid-operated cylinder 107 which is secured to the upper rotating plate 133. Thus, movement of the piston of each respective cylinder 107 up and down causes movement of the respective unit 127 therewith. Each workpiece attaching shaft 102 is hollow through which a respective central shaft 110 extends, the two shafts forming a dual-shaft structure. A spring 111 is interposed between the upper portion of each central shaft 110 and the respective hollow shaft 102, normally urging shaft 110 to assure a raised position relative to the respective hollow shaft 102. Disposed above each of the central shafts 110 is a respective fluid-operated cylinder 112 which is rigidly supported, e.g. by means of the respective bearing 103 fixed on the respective base plate 104, and is fixed to the upper rotating plate 133. Thus, at the lower position of the piston rod 113 of each cylinder 112, the forward end of each piston rod 113 forces the respective central shaft 110 down against the action of the respective spring 111. The lower end of each central shaft 110 has a pin 114 as indicated in FIG. 12 which supports a bell-crank assembly for holding a workpiece. Each assembly consists of two arms 115 and 116 having at first ends thereof elongated apertures receiving the respective pin 114 (see FIG. 13). Thus, movement of each central shaft 110 up and down causes a pivoting rotation of the crank arms 115 and 116 about the respective pivot pins 117 and 118 to that the arms can hold and release workpieces. A respective horizontal rod 119 is connected to each piston rod 113, and has an iron piece 120 at the forward end thereof which actuates a respective micro switch 121 secured to a support 131 of the frame for supplying signals of the positions of the central shafts 110. The number of these micro switches 121 corresponds to that of the workpiece attaching shafts 102. A micro switch 121 is provided for each of the shafts, and can detect whether the crank arms 115 and 116 are open or closed to hold a workpiece from its vertical position, and whether the shaft is facing the fed workpiece and is ready to hold a workpiece from its horizontal position, that is, which micro switch 121a through 121h the dog 120 is actuating. A respective outer cylindrical casing 122 surrounds each base plate 104 as shown in FIG. 11. A vertical support arm 123 is secured to each casing and has an iron piece 124 at the top thereof. Each iron piece 124 actuates a micro switch 125 fixed to the support 131 of the frame. The number of micro switches 125 corresponds to that of the workpiece attaching shafts 110. Micro switches 125 are spaced at regular intervals, and one micro switch 125 is provided for each shaft 110. This micro switch 125 can detect whether the central shaft 102 is in its lower position or raised positions, namely whether a workpiece is buried in an abrasive media and is ready to have a finishing process or is moved up away from the abrasive media. A respective horizontal member 126 is rigidly connected to the top of each cylinder 107, and has three micro switches 135, 136 and 137 at the forward end thereof. A respective iron piece 128 is provided on the support 131 of the frame and is adopted to actuate micro switches 135, 136 and 137. Each iron piece 128 has three different positions indicative of the positions of the respective finishing unit 127, i.e. at the position for finishing, at the position for removing the finished workpiece or at the position for chucking the unfinished workpiece. Thus, when each iron piece takes these three positions, it actuates the corresponding micro switches to issue the signal that each finishing unit is in the corresponding operations. It is described herein that each finishing unit can have three different operations, but the number of the operations may be two or more than three. In other words, finishing units 127 are arranged in their respective positions as shown in FIG. 10 to revolve intermittently. When each is placed in specified positions, it is instructed to have specified operations depending upon the specified positions. For driving the finishing units 127 together with the upper and lower rotating plates 133 and 134 intermittently about the central shaft 130, there is shown and described an example in which a known Geneva gear is used. The construction is shown in FIGS. 9 and 10, in which the Geneva gear 138 has n number of teeth which corresponds to the number of desired indexes, and is connected to the central shaft 130 as shown. Reduction gears 140 are mounted on the top plate 132, and have a disk **139*a* provided with two pins 139 which engage gaps between the adjacent teeth of the gear 138. An index motor 141 is also mounted on the top plate 132 for driving the reduction gears 140. This index motor 141 is energized by electrical signals to rotate one full turn each time a signal is received, and one full turn of the disk of the reduction gears causes a 1/n rotation of the central shaft 130 by way of the Geneva gear 138 engaged by two pins 139 on the disk 139*a*. For operating fluid-operated valves on the rotating portion, a central fluid introduction valve 142 is provided in the central shaft 130 for allowing pressurized fluid to be supplied to each valve through an introduction pipe 143, as shown in FIG. 10. To this end, a swivel joint is rotatably connected to the top of the central shaft 130 for connecting a pipe 143 and the central valve 142. A finishing tub 144 is disposed on the bottom plate 108. The finishing tub may be either stationary or rotatable, and a rotatable tub is shown and described in FIG. 9. The rotatable tub is fixed to its drive shaft 129 to which a chain wheel or pulley 145 is also fixed. Thus, the shaft 130 or tub 144 is rotated by an electric motor 147 by way of the chain wheel or pulley 145 and reduction gears 146. A compound tank 148 for circulating and cleaning compound solution in the tub 144, and a source 149** for supplying pressurized fluid are additionally provided.

Figure 14:
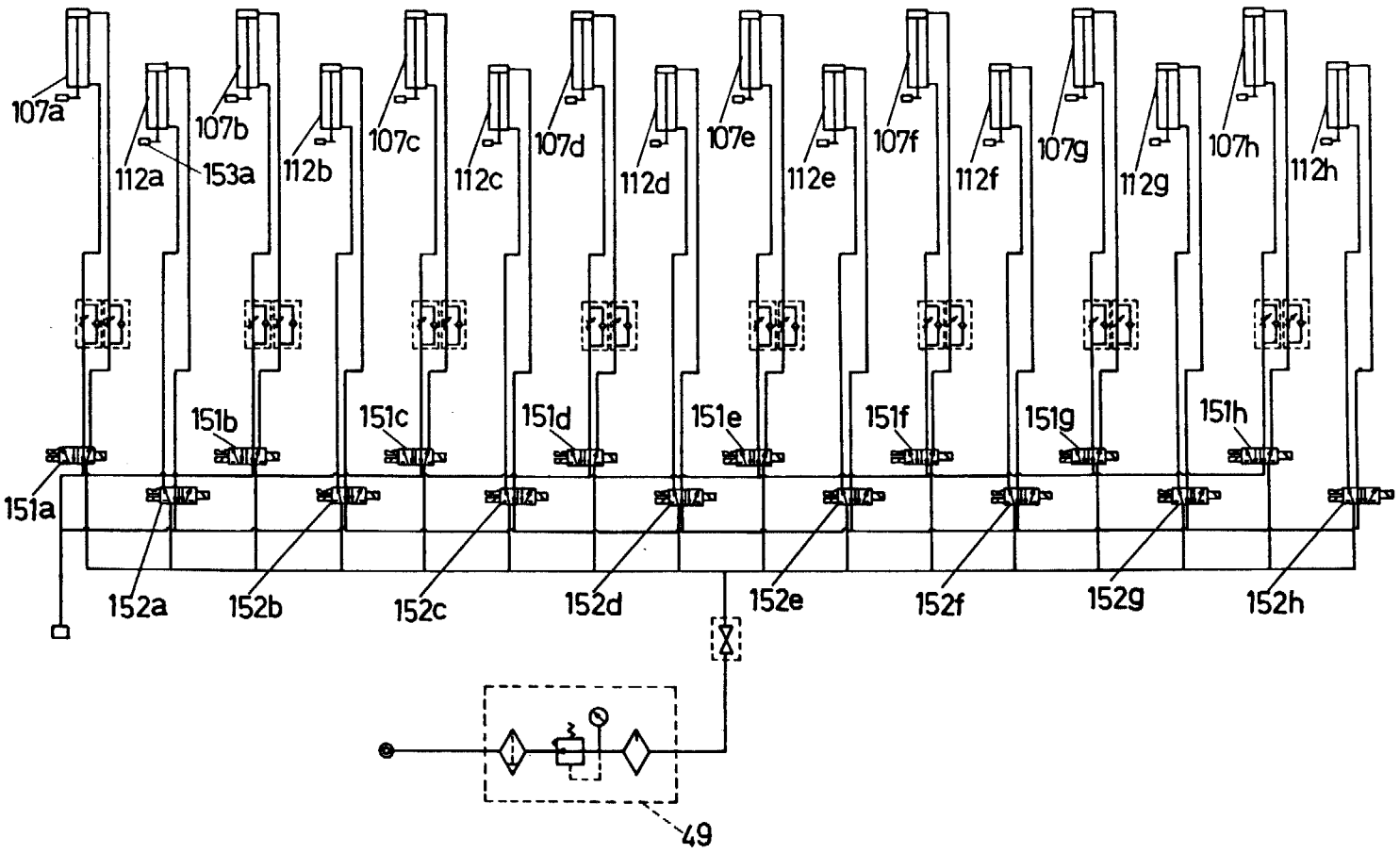
FIG. 14 is a schematic diagram of fluid pressure piping system in the gyro-finishing apparatus.

The construction according to the invention has been illustrated, and a description of its operation will now be given. Workpieces to be processed are supplied piece by piece on the workpiece charging conveyor 4 as shown in FIG. 2. The placement of workpieces in carried out from the direction of arrow 50, either by another feeding device, which is not shown in the figure, or manually. Workpieces carried by the conveyor 4 are gripped piece by piece by the robot hands 6 at the end of the conveyor 4. The robot hands 6 then move each workpiece toward the chucking device **10*c* disposed between the slit deburring means 10*a* and 10*b*, and the chucking device 10*c* chucks it. This chucking can be achieved by placing a workpiece in a fixed position by allowing the holder 10*c* shown in FIG. 3 to hold the workpiece from a side of the workpiece. When the chucking is completed, it is detected by means of a dog and micro switch, and a signal from the micro switch energizes the motors 20*a* and 20*b* to rotate tools 22*a*, 22*b*, and causes pressurized fluid to be introduced into both sides of the piston in the fluid-operated cylinder 18 alternately, which in turn alternately lowers and lifts the rotating tools 22*a* and 22*b*, which contact with the slit 3 of the workpiece, thus removing burrs on both sides of the slit 3 of the workpiece. The period of this deburring operation is controlled by a timer, and at the end of the operation a signal from the timer causes pressurized fluid to be withdrawn from the piston side of the cylinder 18 while it causes pressurized fluid to be introduced into the piston rod side of the cylinder 18, thus stopping the tools 22*a* and 22*b* at their upward position. The workpiece is then transferred to the central bore polish means 11 and then to the central bore deburring means 12*a* and 12*b*. Reciprocation of rotary tool 32*a* will polish the inner bore of the workpiece by the polishing means 11, and thereafter rotary tools 32*b* and 32*c* will remove burrs from the edges of the central bore. After these operations are completed, the workpiece is gripped by the robot hands 7 which transfer it toward the inlet side of the gyro-finishing means 47 from which it is handed over to further robot hands or loader 48 which place it in position on the gyro-finishing means 47. For the operation of the gyro-finishing means 47, the finishing tub 44 containing abrasive media and if necessary compound solution is always rotating, and workpiece attaching shafts 102, other than the shafts 102*a* and 102*h*, with workpieces attached thereto, are moved down to submerge the workpieces in the media and to rotate the workpieces therein. Thus, the surface conditioning is performed by rotating the workpieces and the tub. Finishing units 127*a* and 127*h* which are located to face the loader 48 and unloader 49 are in their raised positions by action of cylinders 107*a* and 107*h* which have pressurized fluid introduced into the piston rod sides thereof when a finished workpiece is removed from the gyro-finishing machine and an unfinished workpiece is chucked into the machine. For example, when the unit 127*g* with a finished workpiece is to be moved to the outlet position occupied by unit 127*h* in the drawings, the micro switch 135*h* is actuated in response to the presence of the iron piece 128*h* on the support 131, and delivers a signal to confirm that the finish workpiece is ready for releasing. The signal actuates an electromagnetic valve 152*h* (see FIG. 14) to allow pressurized fluid to be introduced into the piston side of the cylinder 112*h*, thus causing the central shaft 110*h* to be lowered. Holding arms 115*h* and 116*h* located opposite the unloader 49 release the finished workpiece and deliver the workpiece to the unloader 49. In parallel with or simultaneously with the above operation an unfinished workpiece is charged into the unit 127*a*. A workpiece to be gyro-finished is carried by the loader 48 to the space between holding arms 115*a* and 116*a* and is gripped thereby. The unit is lowered and moved to the position of 127*b*, whereat finishing of the unfinished workpiece is begun. To describe this operation in more detail, a signal from the loader 48 actuates the electromagnetic valve 152*a* to allow pressurized fluid to be introduced into the piston rod side of the fluid-operated cylinder 112*a*, thereby moving the central shaft 110a upwardly which in turn operates the holding arms 115a and 116a to hold the workpiece. Then, the dog 120a on the piston rod of the cylinder 112a responds to the limit switch 121a fixed on the frame 131 and the limit switch 121a is actuated to deliver a signal which in turn causes the loader 48 to be moved from the arms 115a and 116a and the motor 105a to be energized. Simultaneously, the signal also actuates the index motor 141 to turn, indexing the upper and lower rotating plates by 1/n turn and the finishing units by 1/n turn therewith. As the index motor 141 completes each turn, a signal is delivered to allow workpieces to be moved in position on and away from the gyro-finishing means. The gyro-finished workpiece, which has been moved away from the gyro-finishing means by the unloader 49, is then transferred onto the carrier 53 (see FIG. 1), which in turn forwards the finished workpieces for after treatments, for instance, water-washing, air-blowing, anti-corrosive treatment processes, etc. if required, from which the workpieces are moved onto the conveyor 5** which carries them toward a next processing step.

The functions and operations of the various deburring and surface conditioning means have been described individually, but it should be noted that during the successive operations, workpieces are placed in their respective positions for the corresponding processes, and all operations involved are performed simultaneously throughout the system so that workpieces are transferred from one process to another at periodic intervals and successively until they have been treated at all the involved processes within the system. Moving out of the system, workpieces are then forwarded to a next process.

Figure 7:
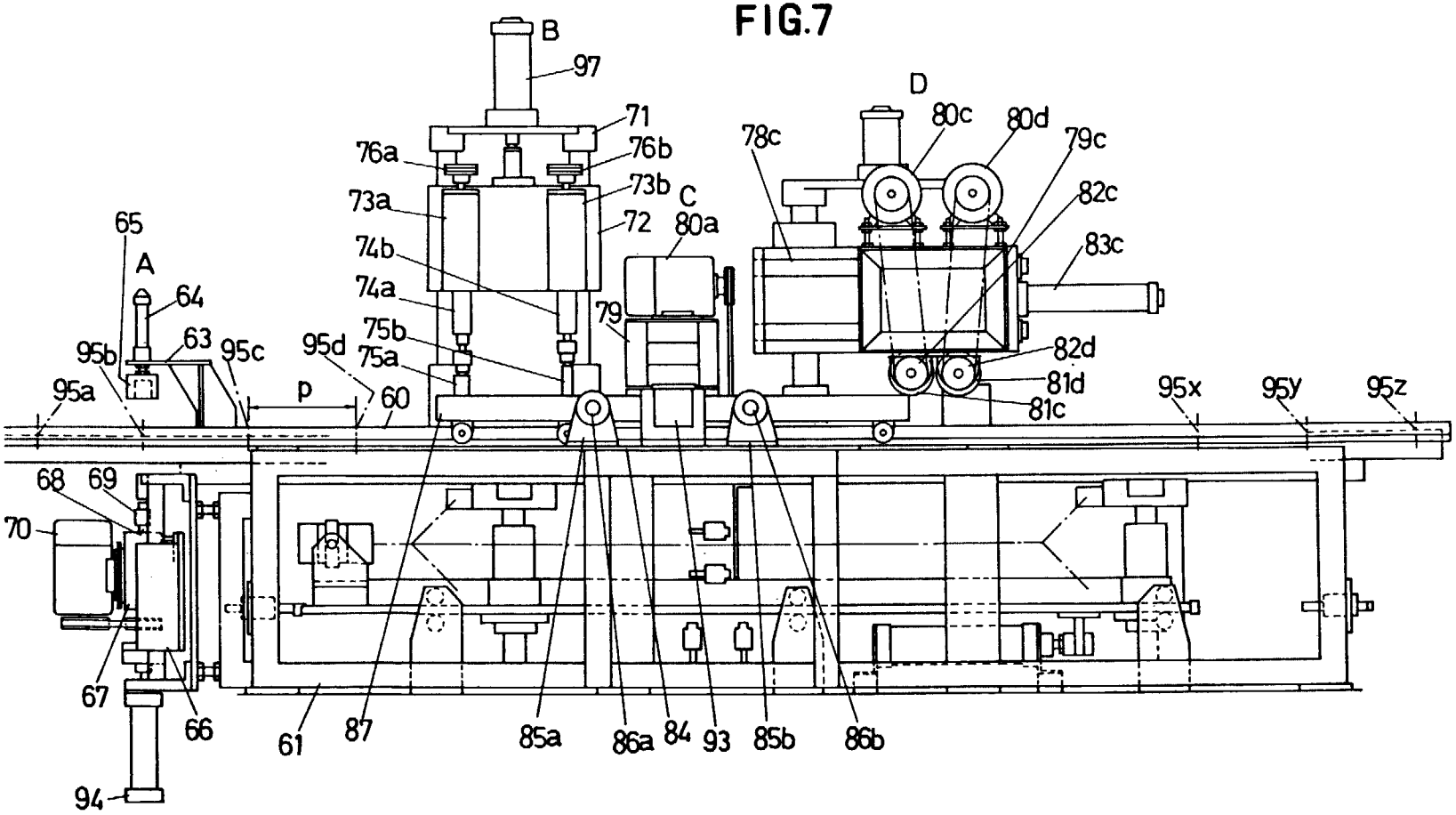
FIG. 7 is a front elevation view of another deburring apparatus to be located before the gyro-finishing apparatus.
Figure 8:
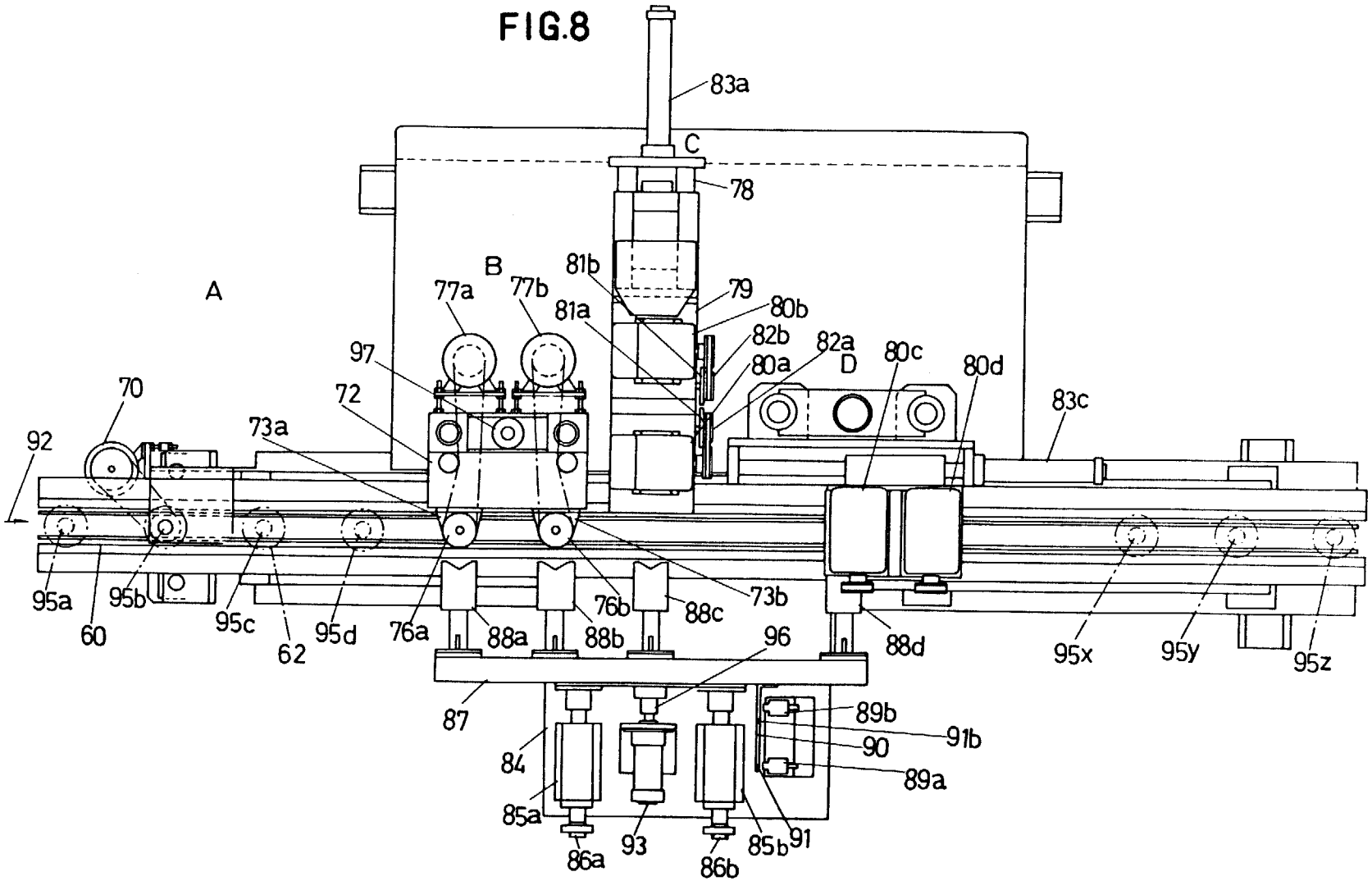
FIG. 8 is a plan view of the apparatus of FIG. 7.
Figure 17:
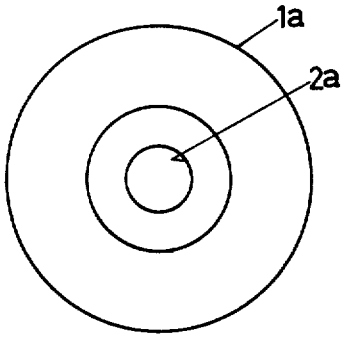
FIG. 17 is a plan view of another typical workpiece to be processed according to the invention.
Figure 18:
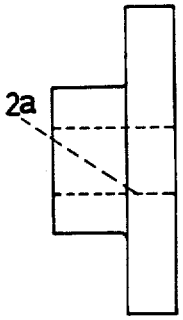
FIG. 18 is a side view of the workpiece shown in FIG. 17.

Another embodiment of the present invention concerns a deburring apparatus designed to remove burrs from a centerbored and flanged workpiece shown in FIGS. 17 and 18. The principal part of this deburring apparatus is the gyro-finishing means as described in the earlier embodiment, and additional deburring steps using the various rotary tools are provided prior to the gyro-finishing step. The construction is shown in FIGS. 7 and 8, which do not show the gyro-finishing means and after-treatment. In this embodiment, the gyro-finishing means is structurally and operationally similar to that shown in FIGS. 9 and 10. In FIGS. 7 and 8, an intermittently driven conveyor 60, which is per se known, runs on a pedestal 61, and carries successive workpieces at the same pitch P. At a deburring station A involving removing burrs from the lower bore, an upright fluid-operated cylinder 64 with its piston rod directed downwardly is rigidly fixed to a frame 63 on the pedestal 61, and the piston rod has a workpiece holder 65 at the forward end thereof. Disposed below the holder 65 is a slider supporting base 66 which is secured to the pedestal 61, the slider supporting base 66 having a slider 67 provided slidably therein. A motor 70 with a vertical shaft is fixed on the slider 67, and a rotary tool 69 is installed at the end of a vertical shaft 68 penetrating the slider 67. Tool 69 and tools 75a, 75b, 81a, 81b, 81c and 81d which are later described are buffs, such as clothes, wires, plastics clothes, plastics wires or other materials including abrasives as mentioned regarding the earlier embodiment of FIGS. 1 to 6. These buffs must have better elastic properties and abrading power. Tool 69 is driven for rotation by means of motor 70. The slider 67 including tool 69 has a vertical sliding movement caused by the operation of a fluid-operated cylinder 94 rigidly secured to the pedestal 61. At a deburring station B, whereat burrs are removed from the upper side bore, an upright slider supporting base 71 is rigidly fixed on the pedestal 61, and has a slider 72 provided slidably relative thereto. Two spaced bearings 73a and 73b rigidly secured to the slider 72 support rotatory spindles 74a and 74b, respectively, which are spaced by a distance equal to the pitch P. Tools 75a and 75b are to be attached to the forward or lower ends of the spindles 74a and 74b. The diameters of the tools 75a and 75b are slightly greater than the central bore size of the workpiece. One tool, shown by 75a in the drawing, in tapered and the other 75b is straight. The tapered tool can debur the edge of the hole and the straight tool can polish the inner bore of the hole. Secured to the upper ends of the spindles 74a and 74b are pulleys 76a and 76b which are driven by respective motors 77a and 77b rigidly mounted on the slider 72. The slider 72 carrying the abovementioned parts is made to slide vertically by the operation of a fluid-operated cylinder 97. At deburring stations C and D are two sets of tools, and two buffs in each set rotate in opposite directions, and each set is arranged to move vertically. Description will now be made of the station C. A slider supporting base 78 is rigidly fixed on the pedestal 61, and a slider 79 is provided on the supporting base 78 for sliding movement caused by the operation of a fluid-operated cylinder 83a. Two motors 80a and 80b are rigidly mounted on the slider 79, below which shafts carrying cylindrical tools 81a and 81b are arranged in parallel with the shafts of the motors 80a and 80b, and have pulleys 82a and 82b driven by the motors 80a and 80b, respectively. The peripheral surfaces of cylindrical tools 81a and 81b can polish the upper surface as well as removing burrs from the center bore and outer edges. Two tool attaching shafts rotate in opposite directions to permit a uniform removing of burrs from the center bore and edges. Deburring station D performs the same finishing and deburring as is done at the station C. The station D has a similar construction to the station C, containing some common parts which operate in the same manner as the parts in the station C and which are designated by subscripts c and d. The tools at the station D are therefore designated by reference numerals 81c and 81d. A workpiece clamping assembly for stations B, C and D includes a pair of bearings 85a and 85b rigidly secured to a plate 84 fixed to the pedestal 61, and shafts 86a and 86b sliding inside the respective bearings 85a and 85b. The shafts 86a and 86b have a plate 87 secured thereto, and the plate 87 has rods 88a, 88b, 88c and 88d secured thereto which correspond to the stations B, C and D, respectively. The forward ends of the rods are V-grooved and adapted to hold the round-shaped workpiece. A fluid-operated cylinder 93 is rigidly disposed on the plate 84, the forward end of its piston rod being secured to the plate 87. The operation of the above-described embodiment of FIGS. 7 and 8 will now be described. Workpieces are fed piece by piece manually or automatically in the direction of arrow 92 and onto carrier 60 which is driven intermittently with the same pitch P. During the operations which are performed successively and simultaneously, individual workpieces are always placed at each position 95a, 95b, 95c. . . 95x, 95y and 95z, and are advanced one by one toward the right in the drawings. It is assumed that during the movement of the carrier 60, all of motors 70, 70a, 70b, 80a, 80b, 80c, 80d are rotating. At the beginning of the operation, when the first workpiece on the carrier is placed at the station A, a signal from the carrier, indicating the workpiece is now ready to be held, causes pressurized fluid to be introduced into the piston sides of the cylinder 64 at station A and the cylinder 93 station D, thus operating the holder 65 to hold the workpiece at station A and holding rods 88*a*, 88*b*, 88*c* and 88*d* to hold workpieces at stations B, C, and D, which are actually not present at stations B, C, and D when the leading workpiece shown at 95*z* at the beginning of the operation is at station A. The workpieces are advanced from 95*a* to 95*b* one by one, and at the stationary state, all stations from 95*a* to 95*z* are filled with workpieces and the above-mentioned operations are performed on each system. When the workpiece is held at station A, pressurized fluid is alternately introduced into the piston side and piston rod side of the cylinder 94. This operation of the cylinder 94 causes movement up and down of the tool 69 while rotating in order to polish the inside of the center bore from the lower side and remove burrs from the lower edge of the center bore. At station B, while the above operation is being performed at station A, the cylinder 97 is also operated to cause movement up and down of the tools 75*a* and 75*b* in order to remove burrs from the upper edge of the center bore and to polish the inside of the center bore on the upper side, respectively. At stations C and D, two sets of tools 81*a*, 81*b* and 81*c*, 81*d* are installed, and each set having two tools rotating in opposite directions can polish the surfaces and remove burrs from the peripheral edges of the center bore. A workpiece at the position 95*z* in FIG. 7 indicates it has gone through all of the involved processes, and is then forwarded to a next process to be performed by the gyro-finishing means.

In the prior art, the deburring has been performed by hand filing and even if deburring is mechanized, buffing or barrel finishing have been used separately. Barrel finishing was found to be the most effective and inexpensive method for deburring, and was also demonstrated to be effective for surface conditioning for successive operations as well as deburring. From the point of view of the line operation, workpieces must be finished piece by piece at the same interval and the so-called batch finishing system is not suitable for automation. An improved gyro-finishing method and apparatus have to be developed and this method was found to fulfil the above requirements. However, the gyro-finishing machine cannot always debur all burrs, although gyro-finishing is perfect for surface conditioning. Buffing methods are added and can debur the burrs that cannot be removed by gyro-finishing. In accordance with the invention, since line operations combining buffing and gyro-finishing are performed, an automated ideal deburring and surface conditioning method and apparatus is provided.

Although the invention has been described with reference to several preferred embodiments thereof, it should be comprehended that various changes and modifications may be made without departing from the spirit and scope of the invention.

What I claim is:

1. An apparatus for deburring and finishing workpieces, said apparatus comprising:

intermittently driven carrying means for forwarding workpieces successively at regular intervals and operable alternately to move distances or pitches equal to said regular intervals during movement periods of time and to be stationary during stationary periods of time;

at least one deburring apparatus positioned adjacent said carrying means, said deburring apparatus including rotating and reciprocating tool means for, during stationary periods of time, removing burrs from successive selected said workpieces, thereby to form semi-finished workpieces;

transfer means for, during stationary periods of time, transferring successively said selected workpieces from said carrying means to said deburring apparatus, and returning said semi-finished workpieces to said carrying means at the original respective locations thereof with respect to the remainder of said workpieces which have moved forward at least one pitch;

chuck means at said deburring apparatus for chucking a said selected workpiece thereat during said step of removing burrs therefrom;

gyro-finishing means, located downstream of said deburring apparatus with respect to the direction of movement of said carrying means, for subjecting successively said semi-finished workpieces to a finishing operation, thereby forming finished workpieces, said gyro-finishing means including a central vertical shaft, support plates fixed to said central vertical shaft, a rotatable finishing tub positioned below said central vertical shaft and containing an abrasive media, a plurality of finishing units supported by said support plates and spaced around said central vertical shaft, each said finishing unit including means for grasping a said semi-finished workpiece, means for lowering the thus grasped semi-finished workpiece into said abrasive media, and means for rotating said semi-finished workpiece in said abrasive media about a vertical axis of the respective said finishing unit, thereby to perform said finishing operation, and means for indexing said central vertical shaft, said support plates, said finishing units and the said grasped workpieces about the axis of said central vertical shaft;

semi-finished workpiece transferring means for, during stationary periods of time, transferring successively said semi-finished workpieces from said carrying means to said gyro-finishing means at an inlet position thereof; and finished workpiece transferring means for, during stationary periods of time discharging successively said finished workpieces from said gyro-finishing means at an outlet position thereof.

2. An apparatus for deburring and finishing workpieces, said apparatus comprising:

intermittently driven carrying means for forwarding workpieces successively at regular intervals and operable alternately to move distances or pitches equal to said regular intervals during movement periods of time and to be stationary during stationary periods of time;

at least one deburring apparatus positioned adjacent said carrying means and including portions on opposite sides of said carrying means, said deburring apparatus including rotating and reciprocating tool means for, during stationary periods of time, removing burrs from successive selected said workpieces, thereby to form semi-finished workpieces;

workpiece holding means for, during stationary periods of time, holding said selected workpieces in position on said carrying means during removal of said burrs;

gyro-finishing means, located downstream of said deburring apparatus with respect to the direction of movement of said carrying means, for subjecting successively said semi-finished workpieces to a finishing operation, thereby forming finished workpieces, said gyro-finishing means including a central vertical shaft, support plates fixed to said central vertical shaft, a rotatable finishing tub positioned below said central vertical shaft and containing an abrasive media, a plurality of finishing units supported by said support plates and spaced around said central vertical shaft, each said finishing unit including means for grasping a said semi-finished workpiece, means for lowering the thus grasped semi-finished workpiece into said abrasive media, and means for rotating said semi-finished workpiece in said abrasive media about a vertical axis of the respective said finishing unit, thereby to perform said finishing operation, and means for indexing said central vertical shaft, said support plates, said finishing units and the said grasped workpieces about the axis of said central vertical shaft;

semi-finished workpieces transferring means for, during stationary periods of time, transferring successively said semi-finished workpieces from said carrying means to said gyro-finishing means at an inlet position thereof; and finished workpiece transferring means for, during stationary periods of time, discharging successively said finished workpieces from said gyro-finishing means at an outlet position thereof.

3. An apparatus as claimed in claims 1 or 2, wherein said tool means comprise at least one tool selected from the group consisting essentially of a cloth buff, a wire brush, and a plastic containing an abrasive media.

4. An apparatus as claimed in claims 1 or 2, wherein each said finishing unit includes an attachment shaft, said grasping means comprises means for raising and lowering said attachment shaft, and means connected to said attachment shaft for holding and releasing automatically said workpieces in response to said raising and lowering, respectively, said rotating means comprises means for rotating said attachment shaft, and said workpiece lowering means comprises means for lowering the respective said finishing unit after the indexing thereof from said inlet position and for raising said respective finishing unit prior to the indexing thereof to said outlet position.

5. An apparatus as claimed in claim 4, wherein said indexing means comprises a Geneva gear system operably connected to said central vertical shaft.

6. An apparatus as claimed in claim 1, wherein said carrying means comprises a conveyor to which said workpieces are supplied, and said transfer means comprise robot assemblies.

7. An apparatus as claimed in claim 2, wherein said carrying means comprises an intermittently driven conveyor.

8. An apparatus as claimed in claim 1, wherein said at least one deburring apparatus comprises a first deburring apparatus including a pair of tools rotatable about respective shafts, and means for reciprocating said shafts and tools in opposite directions substantially transverse to the axes of said shafts, and a second deburring apparatus including plural tools rotatable about respective shafts, and means for reciprocating at least one of said shafts and tools in opposite directions longitudinally of said shafts.

9. An apparatus as claimed in claim 2, wherein said at least one deburring apparatus comprises a first deburring apparatus including at least one tool rotatable about a vertically reciprocable shaft, and a second deburring apparatus including at least one pair of tools rotatable about respective shafts in opposite directions, and means for reciprocating said pair of tools and shafts in opposite directions substantially transverse to the axes of said shafts.

10. An apparatus as claimed in claim 9, wherein said first deburring apparatus includes first and second said vertically reciprocable shafts and respective tools, said second shaft and tool being positioned downstream of said first said tool and shaft, one said tool and shaft being positioned below said carrying means, and the other said tool and shaft being positioned above said carrying means.

11. An apparatus as claimed in claim 9, wherein said second deburring apparatus includes first and second said pairs of tools and respective shafts, said shafts of said first pair extending in directions substantially transversely of said shafts of said second pair.

* * * * *